US008490903B2

(12) United States Patent
Chen

(10) Patent No.: US 8,490,903 B2
(45) Date of Patent: Jul. 23, 2013

(54) THICKNESS DETECTING SAFETY SHREDDER

(75) Inventor: Guanglong Chen, Shanghai (CN)

(73) Assignee: Aurora Office Equipment Co., Ltd, Shanghai (CN)

( * ) Notice: Subject to any disclaimer, the term of this patent is extended or adjusted under 35 U.S.C. 154(b) by 397 days.

(21) Appl. No.: 12/879,960

(22) Filed: Sep. 10, 2010

(65) Prior Publication Data

US 2011/0297766 A1 Dec. 8, 2011

(51) Int. Cl.
*B02C 25/00* (2006.01)

(52) U.S. Cl.
USPC ..... 241/36; 241/100

(58) Field of Classification Search
USPC ..... 241/36, 100, 236
See application file for complete search history.

(56) References Cited

U.S. PATENT DOCUMENTS 8,201,761 B2 * 6/2012 Jensen ..... 241/36
2011/0297770 A1 * 12/2011 Matlin et al. ..... 241/36

* cited by examiner

*Primary Examiner* — Mark Rosenbaum
(74) *Attorney, Agent, or Firm* — WHGC, P.L.C.; John F. O'Rourke; Erick P. Wolf

(57) ABSTRACT

A thickness detecting system for a paper shredder having a lever arm extending into the shredder's throat. One or more sensors may be in communication with the lever arm and configured to measure the rotation of the lever. A first maximum thickness and second maximum thickness may correspond to the paper inserted into the throat before and during shredder, respectively. Circuitry may reverse the motor when the thickness is exceeded to ease the removal of the paper and to prevent further shredding. A touch structure and the preferential power supply switch may be used to engagingly interact with each other, so that the motor can be switched off when the plate is selectively positioned to close the paper feed opening, can be switched on when the plate is selectively positioned to open the feed opening, and can be switched off when unexpected items are introduced into the feed opening.

15 Claims, 8 Drawing Sheets

THICKNESS DETECTING SAFETY SHREDDER

FIELD OF THE INVENTION

This invention relates to office equipment and paper shredders, in particular to a thickness detecting mechanism for a paper shredder incorporating a counterweighted lever arm configured to communicate with rotational sensors for reliably measuring the thickness of media inserted into a feed opening before and during the shredding process. When the thickness detecting mechanism senses overly-thick media, the shredder may be stopped and the motor may be reversed to assist a user to remove the media.

BACKGROUND OF THE INVENTION

Currently, paper shredders may incorporate a variety of thickness detectors which can be expensive, complicated, and prone to failure. Thickness may be measured with a pivoting member extending into the throat of the shredder. When paper is inserted into the shredder, it may contact the pivoting member and force the pivoting member to rotate about its axis. In turn, the opposite end of the pivoting member, which is placed outside of the throat and generally in the upper cover of the shredder, may move upwardly. That end of the pivoting member may be in communication with a sensing device which measures the degree of rotation of the pivoting member to approximate the thickness of the paper. When the measuring device determines that the pivoting member's rotation has exceeded a predetermined threshold corresponding to a predetermined maximum thickness of the paper, circuitry coupled to the measuring device may direct the shredder to perform an operation such as shutting the shredder off so that the shredder's motor is not damaged by the overly-thick paper.

In application, the thickness detector's measurement of paper thickness may vary as the paper is shredded due to many factors such as the cutting blades shaking the paper back and forth as the paper is shredded. This shaking, often referred to as fluttering, may cause the thickness detector to rotate excessively and incorrectly signal that the thickness of the paper has exceeded the predetermined maximum thickness when the actual thickness of the paper may be within the shredder's capacity range. As such, the paper shredder may prematurely shut-off, even though the actual thickness of the paper has not exceeded the shredder's capacity.

Control circuitry utilizing algorithms has been developed in an attempt to correct for the inaccurate thickness measurement caused by paper shaking. Also, fixed counterweights have been incorporated into the thickness detecting assembly to dampen the movement of the pivoting member. In some instances, the fluttering of the paper may be measured by the thickness detector and, in connection with specially programmed circuitry; the predetermined maximum thickness threshold may be temporarily raised to account for the false readings caused by the paper shaking back and forth.

Also, thickness detecting systems may just notify users that the maximum thickness capacity of the paper shredder has been exceeded, but do nothing more than prevent the paper shredder from operating until the paper is removed from the feed opening.

What is needed is a reliable and cost-effective solution for accurately measuring the thickness of material inserted into a paper shredder prior to and during the operation of the shredder's motor, as well as for assisting users to safely remove the paper from the throat.

SUMMARY OF THE INVENTION

The present invention is directed to a thickness detecting system for a paper shredder having a lever arm extending into a throat of the paper shredder where the lever arm is configured to rotate responsive to contact with shredding media, such as paper. A spring may be used in connection with the lever arm to provide resistance to rotation of the lever arm and a counterweight may also be coupled to the lever arm to dampen unwanted vibration associated with the lever arm's rotation. One or more sensors may be in communication with the lever arm and configured to measure the rotation of the lever arm and output a signal corresponding to the lever arm's position.

The sensors may be configured to measure the lever arm's location at different points of rotation. For instance, a first predetermined maximum thickness may correspond to the paper inserted into the throat causing the lever arm to rotate such that it activates a first sensor prior to the engagement of the shredder's cutting blades. In this instance, the shredder may be turned on, but the motor may not yet be activated. If the thickness of the paper causes the lever arm to block the first sensor, circuitry controlling the shredder's motor may reverse the motor to ease removal of the paper and to prevent further shredding.

If the paper does not trigger the first sensor prior to the motor's operation, the paper may still trigger the first sensor once the motor is operating because the cutting blades may shake the paper back and forth in the throat. In this instance, a second sensor may detect whether the lever arm exceeds a second position corresponding to further rotation of the lever arm. This may occur because the shaking of the paper causes the lever arm to rotate further than it would prior to activation of the motor. If the lever arm rotates further to the point where the second sensor is activated while the paper is being shredded, the circuitry may stop and/or reverse the motor to ease removal of the paper and to prevent further shredding.

In another embodiment, the thickness detecting system may be incorporated with a feed opening protection system. The feed opening protection system may include an upper cover and a plate coupled to the upper cover of the shredder. The upper cover may have a longitudinally-oriented opening, and the plate may be selectively positioned to cover the feed opening, so that the feed opening may be either open or closed. The plate can be configured with a touch structure or a preferential power supply switch and the upper cover can be configured with a preferential power supply switch and a touch structure. The touch structure and the preferential power supply switch may be configured to engagingly interact with each other, so that the motor can be switched off when the plate is selectively positioned to close the paper feed opening, can be switched on when the plate is selectively positioned to open, or uncover, the feed opening, and can be switched off again when unexpected items are introduced into the feed opening, deflecting the selectively positioned plate. The upper cover and the plate can be configured to be an integrated element, or may be configured as separate elements.

Beneficial features of the present invention include:

1. A thickness detecting system which can be inexpensive to manufacture that reliably and accurately determines the thickness of media, such as paper, in connection with a plurality of sensors and a sprung and counterweighted lever arm such that the operating capacity of the paper shredder is not exceeded.

2. A thickness detecting and reversing system which can be inexpensive to manufacture that upon detection of media, such as paper, exceeding a predetermined thickness, stops and/or reverses the direction of the motor powering the cutting blades and eases the removal of paper from the shredder and thereby reduces risk of injury from contact with the cutting blades.

3. A thickness detecting and reversing system that also enables a touch structure and a preferential power supply switch to interact with each other, resulting in a simple protection, thickness measuring, and reversing system, which can be inexpensive to manufacture.

BRIEF DESCRIPTION OF THE DRAWINGS

The invention is generally shown by way of reference to the accompanying drawings in which.

DETAILED DESCRIPTION OF THE INVENTION

Some embodiments are described in detail with reference to the related drawings. Additional embodiments, features and/or advantages will become apparent from the ensuing description or may be learned by practicing the invention. In the figures, which are not drawn to scale, like numerals refer to like features throughout the description. The following description is not to be taken in a limiting sense, but is made merely for the purpose of describing the general principles of the invention.

Figure 1:
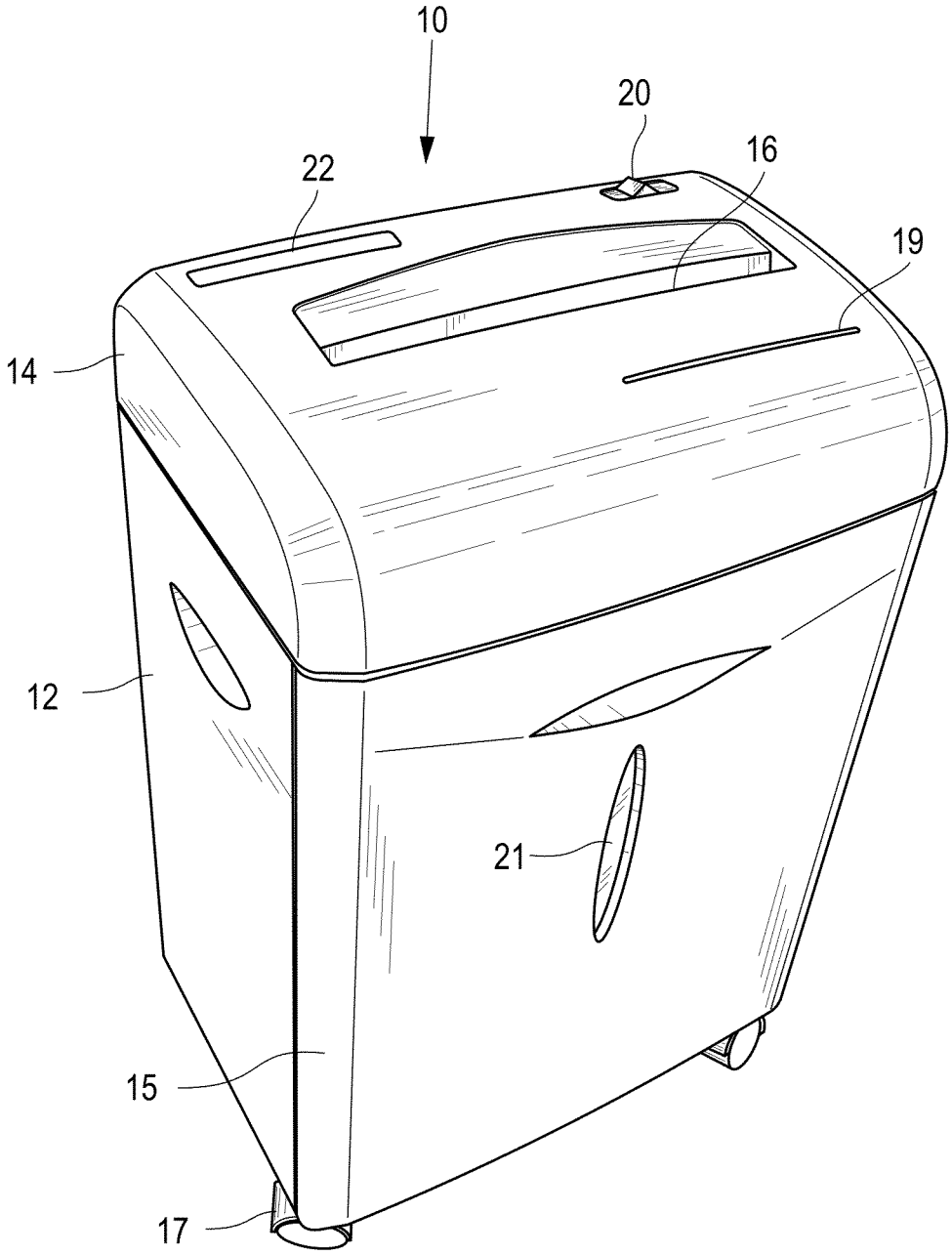
FIG. 1 shows a perspective view of an embodiment of a shredder of the present invention.

Referring to FIG. 1, a paper shredder 10 is shown having a basket 12 and an upper cover 14 with openings therein. The basket includes a drawer 15 which is configured to receive shredded material. The drawer may slide out from the basket so that it can be easily emptied. In alternative embodiments, the basket may be a one piece unit such that the shredded material is accessible by removing the upper cover from the basket. A window 21 is incorporated into the drawer so that a user can observe the amount of shredded material contained therein to determine whether or not the drawer needs to be emptied. In alternative embodiments, the basket may incorporate a monitoring system to detect when the basket has reached its maximum capacity and notify a user accordingly. Casters 17 are located at the base of the basket so that the shredder can be easily moved. In alternative embodiments, the shredder may consist primarily of an upper cover. In these embodiments, a user may provide a suitable basket or other device to receive the shredded material. In further alternative embodiments, the shredder may assume other configurations including, but not limited to, portable configurations or larger configurations for heavy-duty shredding.

Paper and similar material may be inserted through a primary feed opening 16 in the upper cover 14 and alternative media such as compact disks and credit cards may be inserted through a secondary feed opening 19. After the paper is inserted through the primary feed opening, it may travel down a primary throat 52 (shown in FIG. 3) of the shredder and into primary cutting blades 18 (shown in FIG. 2). When alternative media is inserted through the secondary feed opening, it may travel down a secondary throat 53 (shown in FIG. 3) and into secondary cutting blades 26 (shown in FIG. 2). The upper cover contains the main components of the shredder including a motor 28 (shown in FIG. 2) configured to operate on direct current, primary cutting blades for shredding paper and similar media, secondary cutting blades for shredding alternative media, an indication panel 22, a power switch 20, circuitry for controlling the shredder, including an integrated circuit, and associated machinery and wiring for facilitating the use and operation of the shredder.

Still referring still to FIG. 1, the upper cover 14 is conformingly fit into the basket 12 and removable from the basket to facilitate easy packing, shipping, storage, maintenance, and emptying of the shredder basket, as well as convenient debris removal from the primary cutting blades 18. The upper cover also incorporates a safety switch (not shown) located on its underside which interfaces with the basket such that the shredder will not operate until the upper cover is secured onto the basket and the drawer 15 is closed. In alternative embodiments, such as where a drawer is not used, the safety switch may be used to determine only if the upper cover is secured onto the basket or onto an alterative shredding media receptacle. In further alternative embodiments, the safety switch may be eliminated as well. In this embodiment, the safety switch is provided to prevent users from accidentally operating the shredder with the primary or secondary cutting blades 26 exposed. The power switch 20 is located on top of the upper cover and is configured to slide back and forth. The power switch has three positions: auto, off, and reverse such that a user can easily control the parameters of the shredder. In alternative embodiments, additional controls and safety mechanisms may be incorporated into the power switch and its operation may be varied from the sliding type shown to alternative configurations such as a rotary knob. The indication panel 22 displays the status of the shredder including power on, overload, overheat, misalignment, and reverse. In alternative embodiments, additional information may be displayed on the indication panel to warn or inform the user accordingly.

Figure 2:
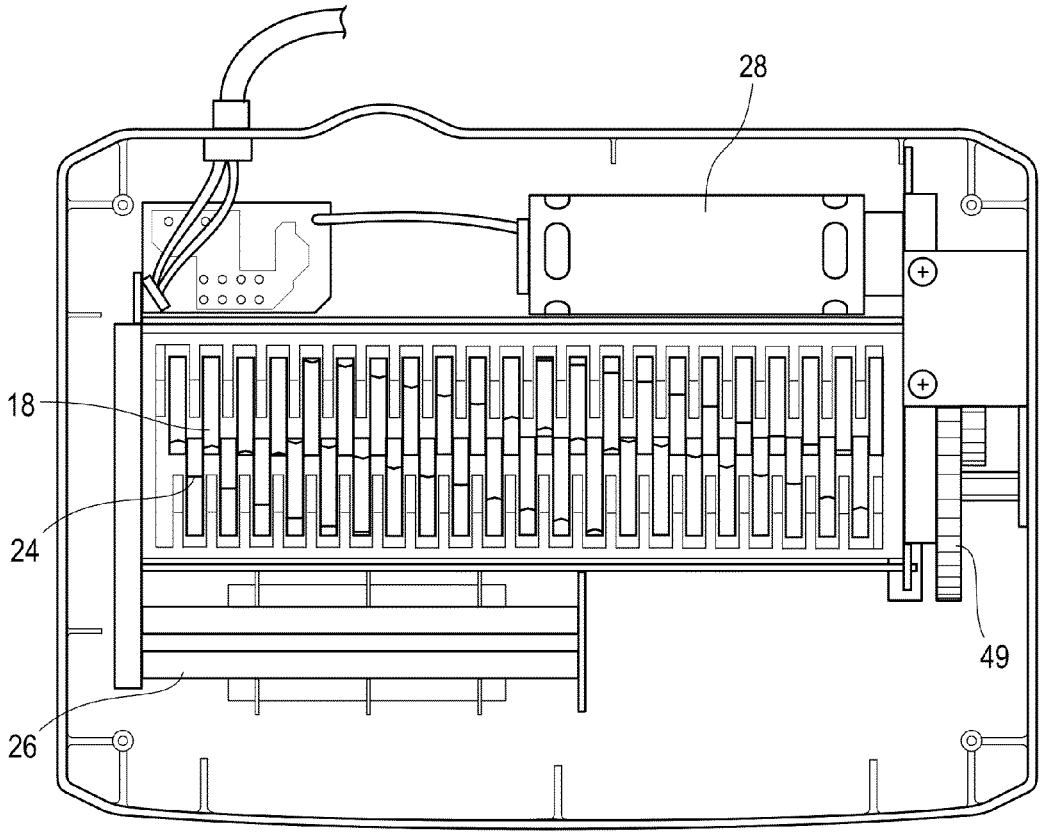
FIG. 2 shows a plane view of an opened upper cover of a shredder of the present inventions.

Referring to FIG. 2, the shredder 10 is configured so that when the paper is inserted through the primary feed opening 16 (shown in FIG. 1), it travels into the primary throat 52 (shown in FIG. 3) of the shredder, passes through the primary media sensor 57 (shown in FIG. 3), and comes into contact with the primary cutting blades 18. In this embodiment, the primary media sensor is an optical sensor. In alternative embodiments, the primary media sensor may take the form of other types of sensors sufficient to indicate the presence of shredding media in the primary throat. If the paper is not greater than a first predetermined maximum thickness, corresponding to approximately 10 sheets of 20 pound paper in this embodiment, the control circuitry will activate the motor 28 to turn the primary cutting blades 18 and secondary cutting blades 26, provided that the paper has passed through the primary media sensor and there is no other condition that would prevent operation of the motor. In other embodiments, the first predetermined maximum thickness may be raised or lowered depending on application. For instance, a heavy-duty shredder may have a predetermined maximum thickness set equivalent to 20 sheets of 20 pound paper. In other alternative embodiments, the first predetermined maximum thickness may be changed corresponding to material selected for shredding or otherwise as necessary depending on the application. In this embodiment, the motor is configured to operate at 3450 revolutions per minute and coupled to a gear reduction system for driving the primary and secondary cutting blades at a lower rate of speed. In alternative embodiments, the motor may have a different configuration, higher or lower capacity, or different speed rating depending on application. The gearing may be changed as well to suit the application.

Once the paper contacts the primary cutting blades 18, the blades grab the paper and cut the paper into strips. The strips are cut further into sections by way of blade points 24 on the primary cutting blades. The secondary cutting blades are located in the secondary feed opening 19 (shown in FIG. 1) and configured to shred alternative materials such as compact disks and credit cards. A secondary media sensor 25 determines when media is inserted into the secondary feed opening and initiates operation of the motor if there are no conditions which would prevent the operation of the motor. Like the primary media sensor 57, the secondary media sensor is an optical sensor in this embodiment. In alternative embodiments, the secondary media sensor may take the form of other types of sensors sufficient to indicate the presence of alternative shredding media in the secondary throat of the shredder. Both sets of cutting blades are driven via gearsets 49 coupled to the motor. The motor is linked to control circuitry coupled to the power switch 20 and the electrical components contained in the shredder.

Figure 3:
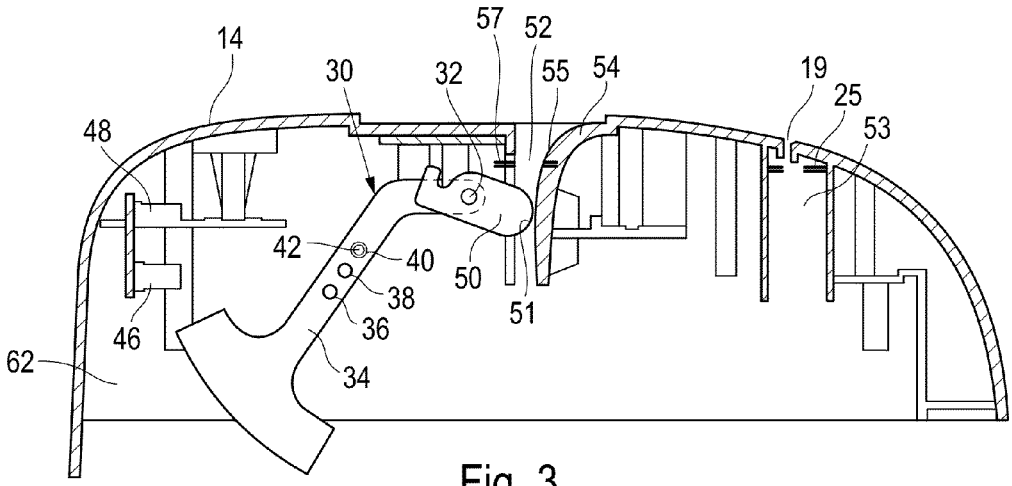
FIG. 3 shows a cross-sectional view of an upper cover of a shredder of the present invention.

Referring to FIG. 3, the primary media sensor 57 is located in the primary throat 52 and configured to signal to the control circuitry when paper is inserted into the primary throat. The primary throat tapers down from the primary feed opening 16 so as to conformingly accept paper and other media for shredding and to direct such material generally into the intersection of the primary cutting blades 18 (shown in FIG. 3). For the purposes of clarity in describing the thickness detecting mechanism, FIGS. 3-7 do not show the primary or secondary 26 cutting blades, motor 28, or associated mechanical structures of the shredding components of the shredder. In alternative embodiments, the primary media sensor may be located at different locations in the throat including, but not limited to, beneath the lever arm 30.

FIG. 3 is illustrative of the shredder prior to the insertion of paper into the primary feed opening 16. A lever arm 30 is partially located in the upper cover 14 and partially located in the primary throat 52. The lever arm is rotatable about an axis 32 in the interior 62 of the upper cover. A proximal component 34 of the lever arm is located in the upper cover and includes openings 36, 38, 40 for accepting a counterweight 42. The counterweight may vary in weight and style depending on application and may be inserted into any of the openings depending on the application. Moreover, depending on application, the style and number of the openings may be changed accordingly. In this instance, the counterweight consists of a screw 43 (shown in FIG. 4) and a weight 45 (shown in FIG. 4) coupled together through the uppermost opening 40. In this embodiment, the combination of the screw and weight weighs approximately 10 grams. In alternative embodiments, the combined weight may be varied as necessary. This configuration may permit the same lever arm, and possibly the same weight, to be used in connection with a number of different types of shredders, by varying the location and weight of the counterweight on the lever arm to account for different configurations and requirements. The counterweight may also be coupled to the lever arm in a number of manners which may include ways in which it is not necessary to utilize the openings and threaded coupling of this embodiment such as by a clip, snap-in attachment, and other means of fastening and positioning. In this embodiment, the ratio of the length of the distal component of the lever arm to the proximal component of the lever arm is approximately 1:5. This ratio may be varied as necessary to account for different configurations and performance requirements.

The proximal component 34 of the lever arm 30 also includes a shutter 44 which is thin enough to pass between first 46 and second rotational sensors 48. In this embodiment, the shutter is a solid, partial disk-shaped device that functions to block either or both the first and second rotational sensors. In this embodiment, the space between the two sets of sensors is approximately 15 millimeters. In alternative embodiments, this spacing may be varied depending on application. Also in this embodiment, the first and second rotational sensors are optical sensors such that when the shutter activates either sensor, the respective sensor is activated. For instance, in the event the lever arm is rotated such that the shutter activates the first rotational sensor, the control circuitry would be notified that the lever arm has exceeded a first limit corresponding to a first predetermined maximum thickness. Similarly, in the event that the lever arm rotates further and the shutter activates the second rotational sensor, the control circuitry would determine that the lever arm has exceeded a second limit corresponding to a second predetermined maximum thickness. In alternative embodiments, the rotational sensors may take the form of other types of sensors sufficient to indicate the position of the lever arm.

Figure 5:
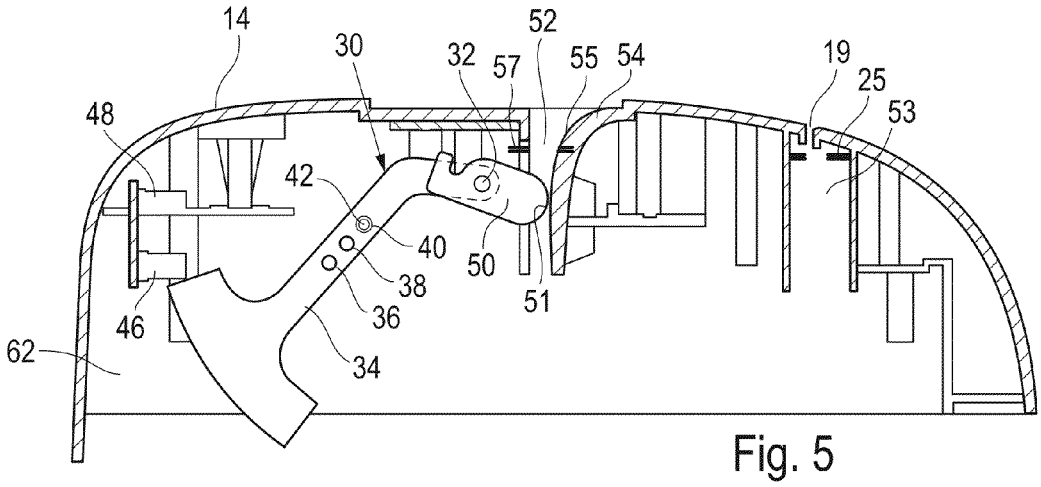
FIG. 5 shows a cross-sectional view of an upper cover of a shredder of the present invention.
Figure 6:
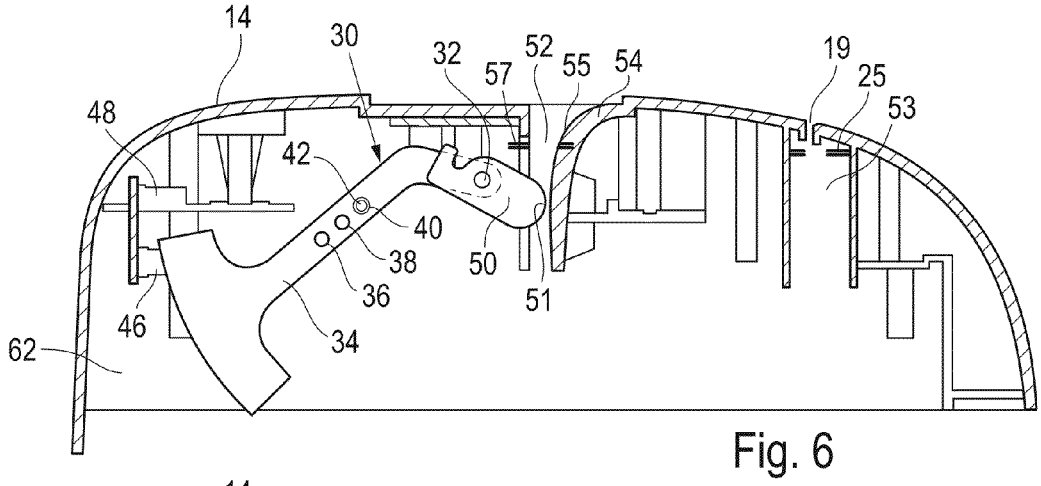
FIG. 6 shows a cross-sectional view of an upper cover of a shredder of the present invention.
Figure 7:
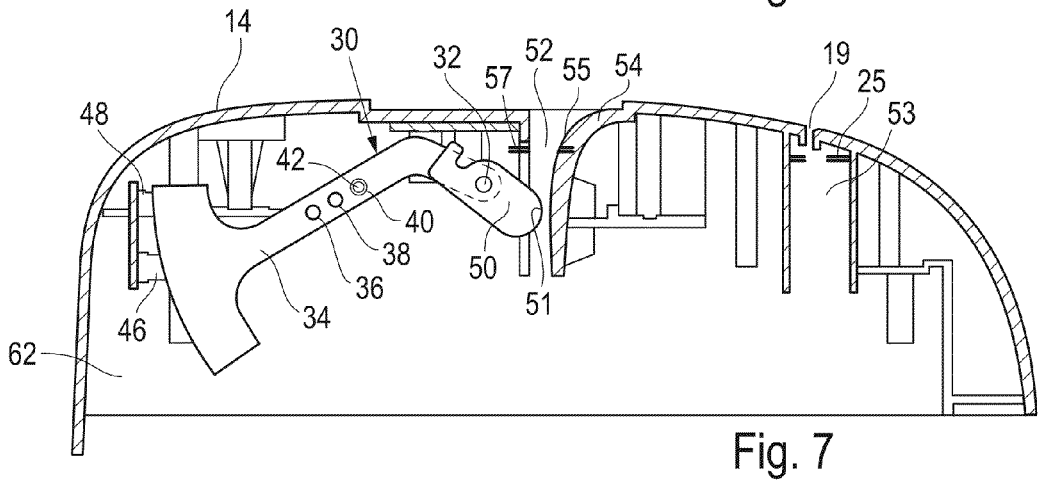
FIG. 7 shows a cross-sectional view of an upper cover of a shredder of the present invention.

A distal component 50 of the lever arm is configured with a curved surface 51 and partially located in the upper cover 14 and partially in the primary throat 52 of the shredder 10. The distal component is configured to pivot the lever arm about its axis 32 corresponding to the insertion of paper through the feed opening and into the primary throat of the shredder. A guiding rib 54 with a curved contacting surface 55 is also located in the primary throat, part of the guiding rib being approximately opposite of the curved contacting surface of the distal component of the lever arm. When paper of a sufficient thickness is inserted into the primary throat, it contacts the curved contacting surface of the distal component of the lever arm on one side and the curved surface of the guiding rib on the other side. Because the guiding rib is fixed to the upper cover and does not move, the distal component of the lever arm is forced downward. In turn, the proximal component of the lever arm moves upward as the lever arm pivots about its axis. FIGS. 5-7 illustrate varying positions of the lever arm due to the insertion of paper through the primary feed opening and into the primary throat of the shredder.

In alternative embodiments, more than one thickness detecting system may be incorporated. For instance, multiple lever arms may be spaced along a primary throat such that media such as envelopes may be accurately measured, whether they are inserted into the center of the feed opening, or along the sides. Similarly, the length of the proximal and distal components of the lever arm may be varied as necessary as well as the shape of the proximal and distal components. Also, the proximal and distal components may be integral or coupled together directly, without the need for a rod. The thickness detector may also include other components for sensing thickness. For instance, a curved roller may be used to interface with incoming media. The roller may extend the length of the primary feed opening to measure thickness of media inserted into most or all of the primary feed opening.

In alternative embodiments, the shutter may be configured with grates and/or openings therein such that rotational sensors may send signals through the shutter. This may be beneficial to precisely track the speed, direction, and position of the shutter as the lever arm as it rotates.

Figure 4:
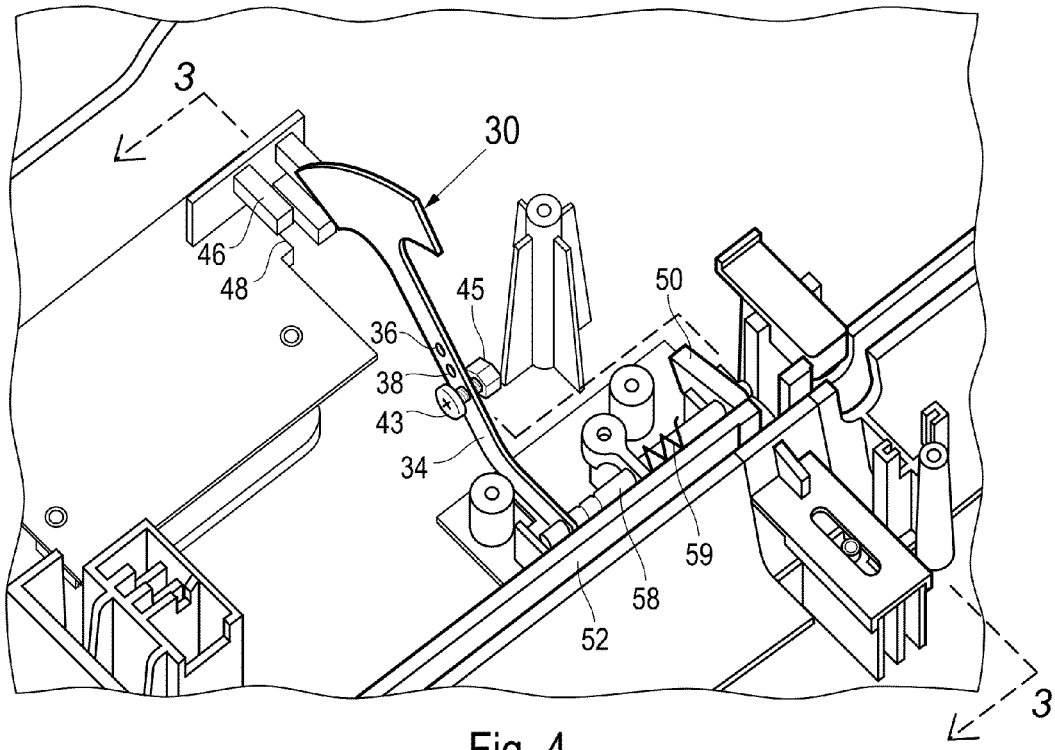
FIG. 4 shows a perspective, cut-away view of an upper cover of a shredder of the present invention.

Referring to FIG. 4, the lever arm 30 includes a central rod 58 laterally spacing and coupling the proximal component 34 of the lever arm to the distal component 50. A spring 59 is positioned around the rod to provide resistance to the rotation of the lever arm when paper is inserted into the primary throat. In alternative embodiments, the spring may be position between the lever arm and the upper cover to provide a similar resistance to rotation. The shutter 44 is configured so that when the lever arm is rotated a sufficient amount, the shutter may block the first rotational sensor 46 and/or the second rotational sensor 48. In this embodiment, when paper exceeding a first predetermined maximum thickness of approximately 10 sheets of 20 pound paper is inserted into the primary throat 52, the lever arm rotates such that the shutter activates the first rotational sensor. Whether the first predetermined maximum thickness is exceeded is determined when the shredder has paper in the primary throat, but before the motor has started operation. In application, after the primary media sensor 57 detects paper in the primary throat (and the motor is not operating), control circuitry determines whether the first rotational sensor is activated by the shutter. If the first positional sensor is activated, the control circuitry will pause and reverse the motor 28. Therefore the direction of the primary cutting blades 18 will be reversed so that the user cannot shred the overly-thick paper as well as to ease removal of the paper from the primary throat. This may also prevent the user the user from inserting his or her fingers into the primary throat and accidentally contacting the primary cutting blades. The motor may also be reversed in other situations such as when it becomes overloaded.

If the paper is sufficiently thin such that it does not rotate the lever arm 30 at all or to a position where the shutter 44 does not block the first rotational sensor, the motor 28 will be activated, provided that the primary media sensor 57 detects the paper and that there are no other reasons, such as overheating or overloading, that would prevent the shredder from operating. Once shredding begins, the paper may shake as a result of the primary cutting blades 18 pulling and shredding the paper. The paper shaking may cause the lever arm to rotate such that the shutter activates the first rotational sensor 46, even though the first rotational sensor was not activated prior to the shredding operation with the same amount of paper in the primary throat 52. In this scenario, the control circuitry will recognize that because the motor is operating, the first rotational sensor may no longer accurately determine whether the paper has exceeded the first predetermined maximum thickness. Accordingly, when the motor is operating, the control circuitry will ignore the first rotational sensor and rely instead on the second rotational sensor 48 to determine whether the thickness of the paper has exceeded a second predetermined maximum thickness.

The second rotational sensor 48 is activated by the shutter 44 after the lever arm 30 rotates to a point past activation of the first rotational sensor 46. The higher positioning of the second rotational sensor in the upper cover 14 corresponds to a second predetermined maximum thickness which takes into account the propensity for shaking that the paper may experience as it is being shredded. More particularly, if only the first rotational sensor 46 were used to measure thickness before and during shredding, the inherent shaking of the paper during shredding may cause the lever arm to trigger the first rotational sensor and incorrectly shut the shredder off even though the paper was initially determined, before shredding, to not exceed the first predetermined maximum thickness. The second rotational sensor's position is calibrated so that it will not normally be activated by paper of an acceptable thickness shaking back and forth during the shredding process. If however, the initial stack of papers is within an acceptable thickness range, but further documents inserted into the shredder during the course of shredding cause the paper to exceed the second predetermined maximum thickness, the control circuitry will stop the motor 28. This may also occur when a user is shredding junk mail such as an envelope containing a credit card wherein the portion of the envelope containing the credit card is outside the thickness range of the shredder. Here, the envelope may initially fall under the first predetermined maximum thickness and the shredder may begin to shred it. However, when the portion of the envelope containing the credit car comes into contact with the distal component 50 of the lever arm, the lever arm may rotate such that the shutter activates the second rotational sensor and the control circuitry stops the motor. When the second rotational sensor 48 is activated and the motor 28 is running, paper will likely be caught in between the primary cutting blades 18 when the motor is then stopped. As such, if a user wants to remove the paper from the shredder, pulling may be required and may be difficult. Therefore, the control circuitry is configured to stop and then reverse the direction of the motor to push out the paper to ease the burden on the user. The motor remains on in the reverse direction for two seconds to clear the paper from the cutting blades so that the user can more easily remove the overly thick paper.

In alternative embodiments, more than two rotational sensors may be used to measure more than two predetermined maximum thicknesses. Such a need may occur when different types of materials are to be shredded and/or the relation of the shredder's capacity to the material's thickness varies.

In additional alternative embodiments, a similar thickness detecting system may be incorporated into a shredder to detect the thickness of material inserted into a secondary feed opening such as credit cards, compact disks, and alternative media.

FIG. 5 may generally illustrate the position of the lever arm 30 after paper thinner than a predetermined minimum thickness has been inserted into the shredder 10. As shown in the figure, the lever arm is slightly rotated corresponding to the insertion of paper through the primary feed opening 16 and into the primary throat 52, causing separation between the curved surface 55 of the distal component 50 of the lever arm and the curved contacting surface 51 of the guiding rib 54. The lever arm rotates such that the shutter 44 moves to a position below activating the first rotational sensor 46. The counterweight 42 provides dampening and the spring 59 (shown in FIG. 4) provides resistance to the rotation of the lever arm responsive to the introduction of the paper into the primary throat. In this scenario, the primary media sensor 57 has already indicated that paper is present in the primary throat and the control circuitry is waiting to determine whether the paper has exceeded the first predetermined maximum thickness before activating the motor 28 to turn the primary cutting blades 18. Here, because the first rotational sensor is not activated, the control circuitry will commence operation of the motor provided that there are no other faults in the system. FIG. 5 may also correspond to a scenario where the shredder is already operating and the paper thickness is below the first predetermined maximum thickness—even during the course of the shredding operation. In this case, neither the first nor second rotational sensors are activated by the shutter and the motor is operating to drive the primary cutting blades.

FIG. 6 may generally illustrate the position of the lever arm 30 after paper has been inserted into the shredder 10 which is thicker than the first predetermined maximum thickness. As shown in the figure, the lever arm is rotated more than in FIG. 5, which corresponds to a greater separation between the curved contacting surface 55 of the distal component 50 of the lever arm and the curved contacting surface 51 of the guiding rib 54. The greater separation may be caused by the insertion of overly-thick paper through the feed opening 16 and into the primary throat 52. The lever arm rotates such that the shutter 44 activates the first rotational sensor 46. In this scenario, the primary media sensor has already indicated that paper is present in the primary throat, but the control circuitry will not operate the motor because the paper has exceeded the first predetermined maximum thickness before the motor 28 has been activated. FIG. 6 may also correspond to the scenario where the shredder is already operating and the paper thickness; while thinner than the first predetermined maximum thickness prior to operation of the motor, exceeds the first predetermined maximum thickness because of shaking caused by the shredding process or because of the insertion of more paper. In this case, because the motor is already operating, the control circuitry disregards the first rotational sensor. As the second rotational sensor 48 is not activated, the shredder is still operated as if the paper falls within an acceptable thickness range.

FIG. 7 may generally illustrate the position of the lever arm 30 after paper has been inserted into the shredder 10 which is thicker than the first and second predetermined maximum thicknesses. As shown in the figure, the lever arm is rotated more than in FIG. 6 which corresponds to a greater separation between the curved contacting surface 55 of the distal component 50 of the lever arm and the curved contacting surface 51 of the guiding rib 54. The greater separation is caused by the insertion of overly thick paper through the feed opening 16 and into the primary throat 52. The lever arm rotates such that the shutter 44 activates the first 46 and second 48 rotational sensors. In this scenario, the primary media sensor has already indicated that paper is present in the primary throat, but the control circuitry will not operate the motor 28 because the paper has exceeded the first predetermined maximum thickness before activation of the motor. FIG. 7 may also correspond to the situation whereby the shredder is already operating and the paper thickness, while below the first predetermined maximum thickness prior to operation of the motor, has now, because of shaking caused by the shredding process or by the insertion of more paper, exceeded the first and second predetermined maximum thicknesses. In this case, because the motor is already operating, the control circuitry disregards the first rotational sensor, but stops the shredder because the shutter is activating the second rotational sensor. The motor is stopped for one half second and then reversed for two seconds by the control circuitry so that the paper is backed out of the shredder to assist a user in removing it.

In alternative embodiments, the first and second rotational sensors along with the control circuitry may be configured to perform different operations. For instance, the control circuitry may monitor the first and second rotational sensors to determine the speed in which the shutter passes the first and second rotational sensors and whether the second rotational sensor is only momentarily activated. In some instances, it may be beneficial to allow the motor to continue to operate in the event that the second rotational sensor is only temporarily activated. Also, the control circuitry may be configured to override the second rotational sensor in some other instances. For example, the shredder may be configured with an option whereby a user may override the first and/or second rotational sensor. In such alternative embodiments, an override button may be placed on the upper cover of the shredder such that a user may temporarily override the first and/or second rotational sensor so that the shredder's capacity is at least momentarily increased. In further alternative embodiments, the speed of the motor and/or the current draw of the motor may be increased corresponding to an override command from the control circuitry or the user.

Figure 8:
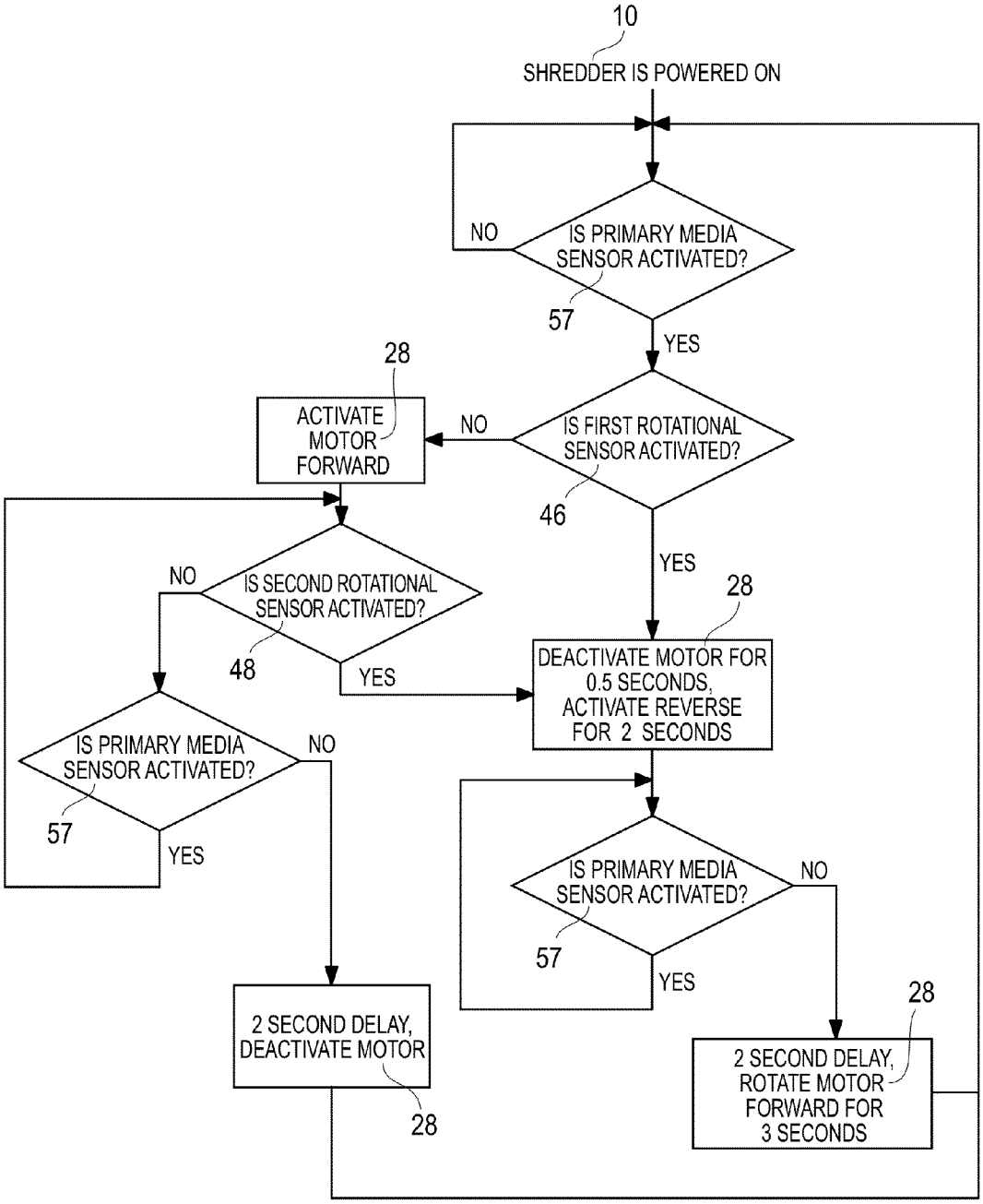
FIG. 8 shows a flowchart describing how an embodiment of the present invention operates.

Referring to the flowchart of FIG. 8, once the shredder is powered on, and positioned in auto mode, the control circuitry will determine whether the primary media sensor 57 is activated. If the primary media sensor is not activated, paper is not present in the upper portion of the primary throat 52 and shredding will not began until the primary media sensor is activated and certain conditions referenced below are met. When the primary media sensor is activated, paper is located in at least the upper portion of the primary throat, and the control circuitry will then determine whether the first rotational sensor 46 is activated before activating the motor 28. If the first rotational sensor is activated, the motor will pause for one half second and then operate in reverse for two seconds to cause the primary cutting blades 18 to reverse to help a user remove any paper that may be located in the cutting blades and to prevent the user from shredding the overly-thick paper. If the first rotational sensor is not activated, the paper does not exceed the first predetermined maximum thickness, and provided there are no other faults causing the shredder not to operate, the motor will power the primary cutting blades to begin shredding. The control circuitry will monitor the second rotational sensor. If the second rotational sensor is activated, the motor will pause for one half second and then operate in reverse for two seconds to cause the primary cutting blades to reverse to help a user remove any paper that may be located in the cutting blades and to prevent the overly-thick paper from being shredded. If the second positional is not activated, the control circuitry will monitor the primary media sensor to determine if paper is still in the upper portion of the primary throat. If the primary media sensor is activated, the motor will continue to operate and the control circuitry will monitor the second rotational sensor and the primary media sensor. When the primary media sensor is no longer activated, indicating that there is no longer paper present in the upper portion of the primary throat, there will be a two second delay to account for shredding the remainder of the paper in the throat and then the motor will be deactivated. In alternative embodiment, the time frames referenced above for performing various actions may be varied as necessary to achieve optimal and/or desired performance of the shredder.

Referring to FIGS. 9, 10, 11, 12, and 13, alternative embodiments may include a feed opening protection structure generally at 64 that may be incorporated with the thickness detecting system, the structure comprising an upper cover 66 and a plate 68. Both the upper cover and the plate can be generally rectangular and oriented to a longitudinal axis and a transverse axis. The upper cover has an obverse side 70 and a reverse side 72 with a longitudinally-disposed feed opening 75 extending through the obverse side to the reverse side. The plate 68 has a topside 71 and a bottom side 73, and is located proximately to the feed opening at the obverse side of the upper cover. In some embodiments, the upper cover and the plate may be integrated. In other embodiments, the upper cover may be separate from the plate.

Figure 9:
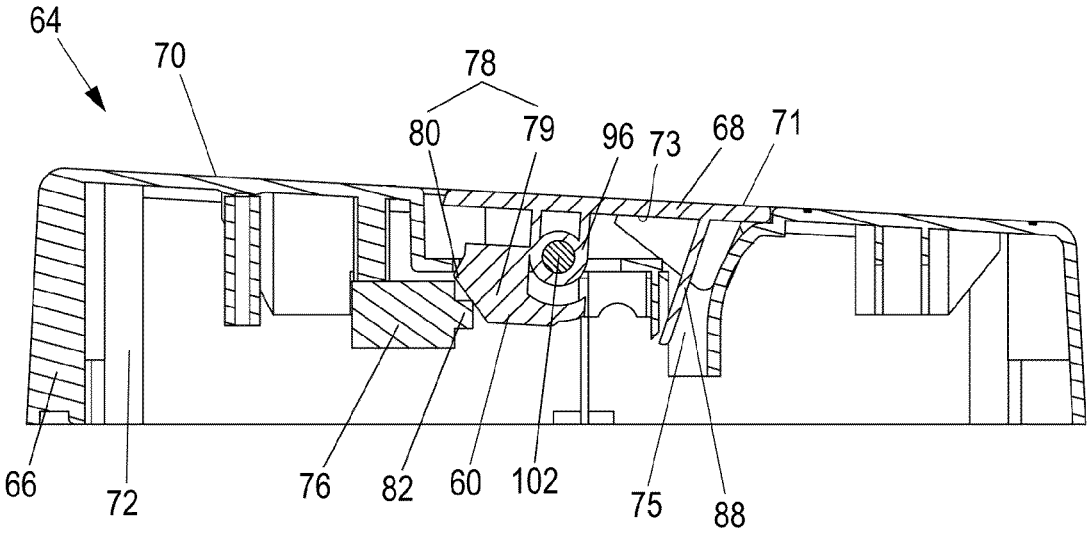
FIG. 9 shows a cross-sectional view of an embodiment of the present invention.
Figure 10:
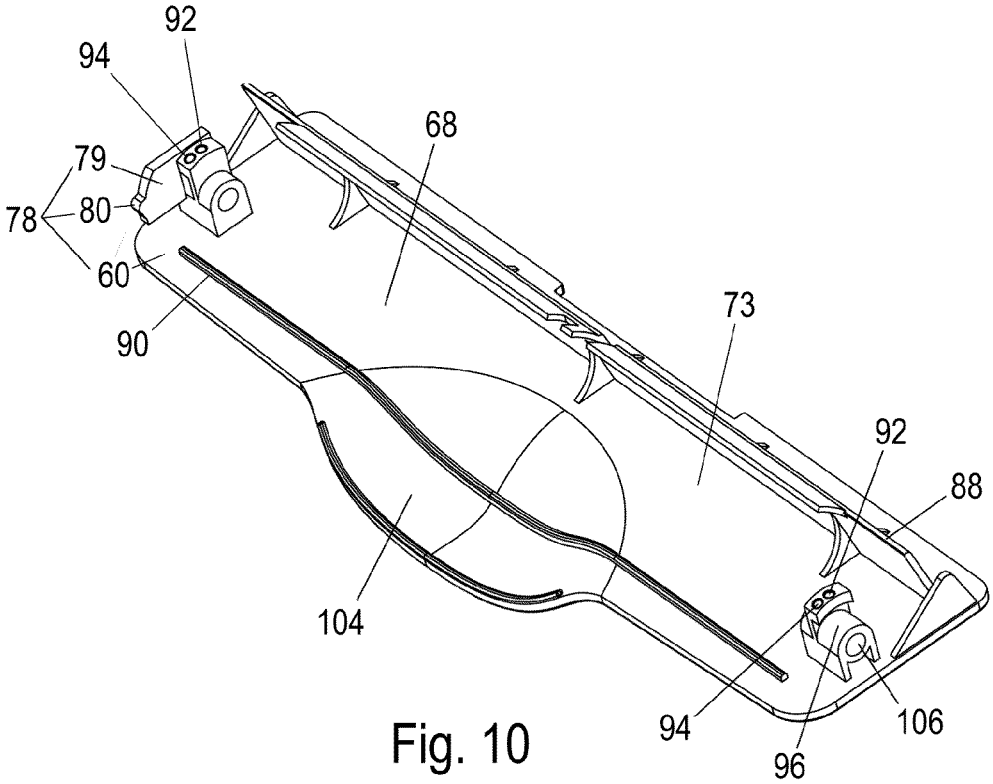
FIG. 10 shows a 3-Dimensional view of the cover plate of an embodiment of the present invention.
Figure 12:
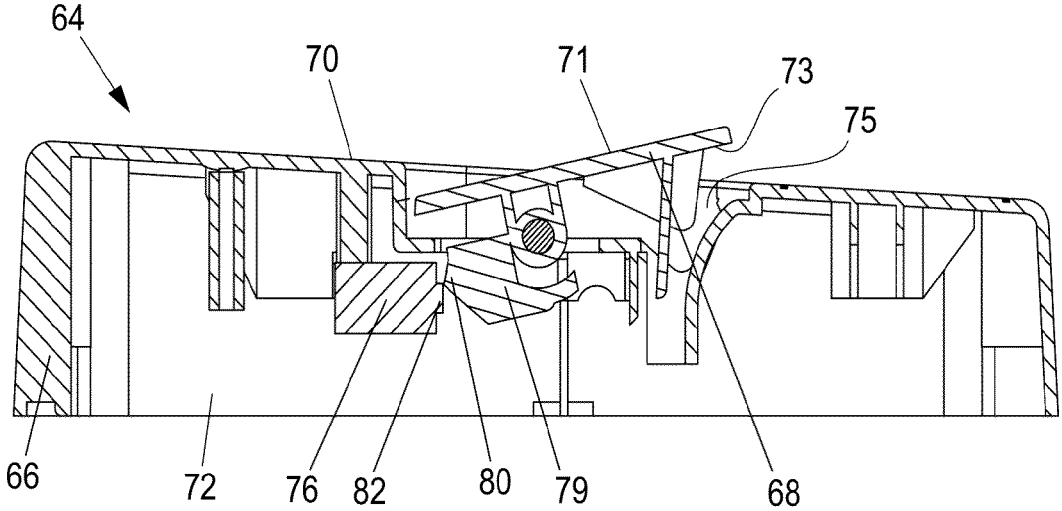
FIG. 12 shows a cross-sectional view of an open paper shredder plate of an embodiment of the present invention.

The plate 68 is configured with a touch structure 60, and the upper cover 66 is correspondingly configured with a preferential power supply switch 76. The touch structure includes a cam 78 including a fundamental cam 79 and a cam point 80 on the fundamental cam. The fundamental cam is fixed on the plate, and the cam point interacts with the touch point of the preferential power supply switch. Alternately, the touch structure can be disposed on the upper cover, and a preferential power supply switch can be disposed on the plate. The touch structure and the preferential power supply switch are designed to interact with each other, and can be constituents of the feed opening protection system 64. The plate is selectively positioned on the feed opening 75 and rotates about an axis formed by the shaft 102. The shaft rotates in the shaft hole 106 (as shown in FIG. 10). The system operates such that when the plate is selectively positioned to close the feed opening (as shown in FIG. 9), the touch structure interacts with the preferential power supply switch to switch off the power supply. On the other hand, when the plate is selectively positioned to open, or expose the feed opening (as shown in FIG. 12), the touch structure interacts with the preferential power supply switch to switch on the power supply. However, when the plate is selectively positioned to open, or expose the feed opening and an unexpected item (i.e., other than paper to be shredded) is fed into the feed opening, the unexpected item forces up, that is, deflects, the plate (as shown in FIG. 13) and interacts with the preferential power supply switch to switch off the power supply.

Referring to FIG. 10, the plate 68 can be configured on opposite sides of a transverse axis of the bottom side, with one transverse side of the plate having a paper stopper 88 extending downwards and inwards, relative to the feed opening 75 (shown in FIG. 12), and the other transverse side being formed with an indented pressing area 104 in the middle section of the outer surface to facilitate pressing. When the plate is lifted and the feed opening is selectively opened, the paper stopper faces downwards so that the paper fed to be shredded can smoothly reach the shredding blade (not shown). Sealing band 90 can facilitate sealing the feed opening, and also can facilitate deflecting the plate should sealing band come into contact with an unexpected item during shredder operation. Thus the sealing band also can be an element of the touch structure 60.

Figure 13:
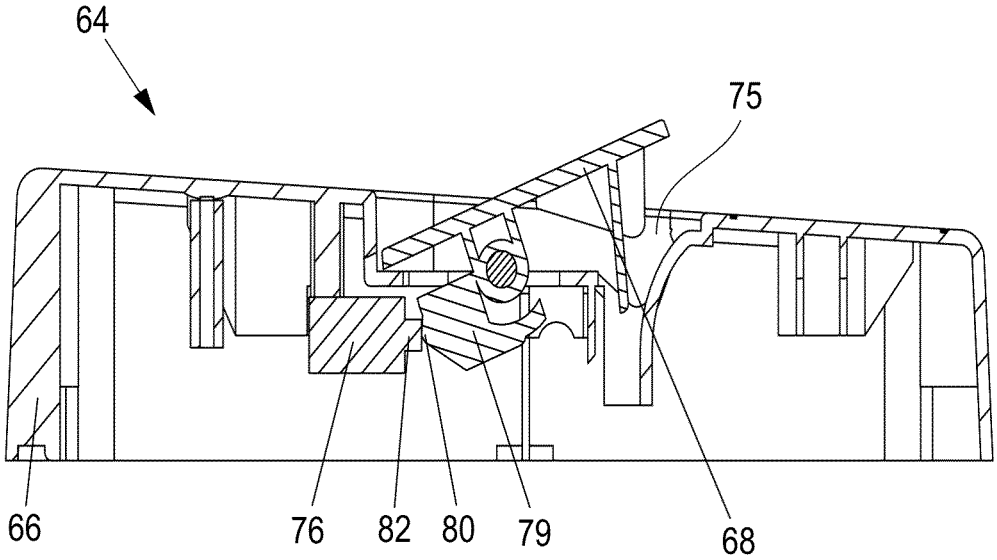
FIG. 13 shows a cross-sectional view of a paper shredder plate in abnormal status of an embodiment of the present invention.

Referring to FIG. 13, deflecting the plate 68 actively switches off the power supply by the interaction of the touch structure 60 on the preferential power supply switch 76. Thus, the system provides user protection by preferentially selecting between enabling or disabling the power supply, while the feed opening 75 is accessible and open. In addition, the system provides protection by switching off the power supply both when the plate is selectively positioned to close the feed opening; and, during normal operation, when an unexpected item enters the feed opening, and deflects the plate.

As indicated above, the preferential power supply switch 76 has a dual protection function. First-level protection is provided when the plate 68 is selectively positioned to close the feed opening 75 (as shown in FIG. 9), making it inaccessible and the power supply is switched off and not electrically conductive. Second-level protection is provided when the plate is selectively positioned to open the feed opening (as shown in FIG. 12), and the plate switches on the power supply to perform normal operation. In the event an unexpected item is introduced into the feed opening, a noticeable force will deflect the plate. The deflection causes the plate to interact with the preferential power supply switch and to switch off the power supply (as shown in FIG. 13).

The touch structure 60 and the preferential power supply switch 76 can be integrated into a single-circuit disconnection device which actively switches off the power supply whenever an unexpected item is fed into the feed opening 75, and which functions reversely as a passive conducting device while feeding paper through the feed opening. The preferential power supply switch is a preferential disconnection device. Different from an ordinary safety switch, or a paper-full switch, whose function is realized, for example, by adopting a flip-flop in a circuit of a paper shredder, the preferential power supply switch has first-level priority in the power supply to protect a user.

The upper cover 66 and the plate 68 refer to separate structures able to seal the feed opening 75, when the plate is selectively positioned to close the feed opening. The upper cover and the plate also may be integrated. The plate and the upper cover are connected such that the former can move separately, and be selectively positioned, relative to the latter.

Referring to FIG. 12, when the plate 68 is positioned for paper shredding, the cam 78 on the plate presses the preferential power supply switch 76. In particular, the cam point 80 presses the touch point 82 of preferential power supply switch, thereby the power supply is switched on and the paper shredder is placed in electrical stand-by. A user then is able to shred paper through the feed opening 74 which is exposed by the selectively positioned plate.

Figure 11:
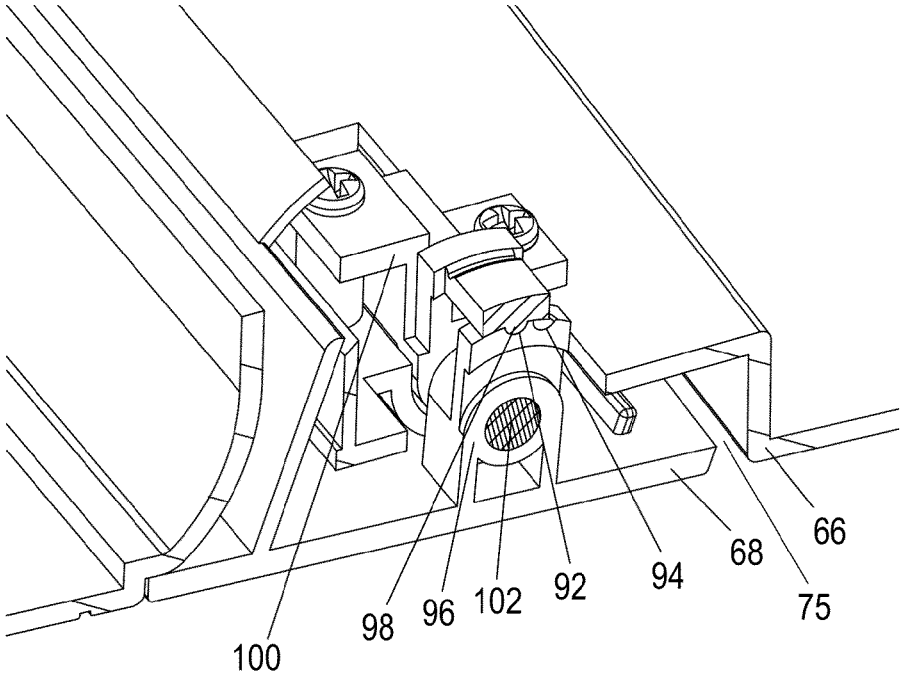
FIG. 11 shows a 3-Dimensional view for a part of a cross-section of an embodiment of the present invention.

Referring to FIG. 13, when the shredder is operating, in the case where a child or a user may accidentally feed an unexpected item, such as a part of his/her body, or a tie, or other article of clothing won by him/her, the plate 68 will further deflect upwards to cause the cam 78 to disengage the power supply, or in particular, to cause the cam point 80 to lose contact with the touch point 82. As mentioned above, since the preferential power switch 76 has the first-level priority to switch off the power supply, the entire paper shredder is switched off and cannot function. Therefore, users and their personal belongs are protected. Moreover, as shown in FIG. 11, due to the adoption of an adjustable closing detent point 92 and an adjustable working detent point 94 on each protruding block 96 on the bottom side 73 of the plate, the protruding point 98 of the shaft base 100 is adjusted to be accommodated in the closing detent point of the plate when the plate is closed, and to be accommodated in the working detent point of the plate when the plate is opened.

While several embodiments have been described in detail, it should be appreciated that various modifications and/or variations may be made without departing from the scope or spirit of the invention. In this regard it is important to note that practicing the invention is not limited to the applications described herein above. Many other applications and/or alterations may be utilized provided that such other applications and/or alterations do not depart from the intended purpose of the invention. Also, features illustrated or described as part of one embodiment may be used in another embodiment to provide yet another embodiment such that the features are not limited to the embodiments described herein above. Thus, it is intended that the invention cover all such embodiments and variations as long as such embodiments and variations come within the shredder of the appended claims and its equivalents.

The invention claimed is:

1. A thickness detecting system for a paper shredder, comprising:

a first sensor positioned in a throat of the paper shredder and configured to output a signal when shredding material is inserted into the throat;

a lever arm extending into the throat, the lever arm configured to rotate about an axis responsive to contact with shredding media;

a spring coupled to the lever arm and configured to provide resistance to the lever arm's rotation;

a removable counterweight coupled to the lever arm and configured to dampen the lever arm's rotation;

a second sensor configured to output a signal when the lever arm rotates to a first position, a third sensor configured to output a signal when the lever arm rotates to a second position; wherein circuitry is coupled to the first sensor, second sensor, third sensor, and a motor coupled to cutting blades and the circuitry is configured to control the operation of the motor responsive to receiving signals from the first sensor, second sensor, and/or third sensor.

2. The thickness detecting system for a paper shredder of claim 1, wherein:

the circuitry is configured to prevent activation of the motor responsive to receiving a signal from the second sensor prior to operation of the motor.

3. The thickness detecting system for a paper shredder of claim 1, wherein:

the circuitry is configured to stop the motor responsive to receiving a signal from the third sensor during operation of the motor.

4. The thickness detecting system for a paper shredder of claim 1, wherein:

the circuitry is configured to reverse the motor responsive to receiving a signal from the second sensor prior to operation of the motor.

5. The thickness detecting system for a paper shredder of claim 1, wherein:

the circuitry is configured to reverse the motor responsive to receiving a signal from the third sensor during operation of the motor.

6. The thickness detecting system for a paper shredder of claim 1, wherein:

the first sensor is an optical sensor configured to output a signal if the sensor's optical path is blocked by the shredding media;

the second sensor is an optical sensor configured to output a signal if the sensor's optical path is blocked by the proximal component of the lever arm; and the third sensor is an optical sensor configured to output a signal if the sensor's optical path is blocked by the proximal component of the lever arm.

7. The thickness detecting system for a paper shredder of claim 1, wherein:

the removable counterweight is threaded into the proximal component of the lever arm.

8. The thickness detecting system for a paper shredder of claim 1, wherein:

the lever arm further comprises:

a rod extending along the axis of the lever arm and separating the distal component of the lever arm from the proximal component, wherein the rod is coupled to the distal component of the lever arm on one end and coupled to the proximal component of the lever arm on the other end; and wherein the ratio between the length of the distal component and the proximal component of the lever arm is less than or equal to 1:5; and wherein the removable counterweight equal to or greater than 10 grams.

9. The thickness detecting system for a paper shredder of claim 1, wherein:

the lever arm further comprises:

a plurality of openings in the proximal component of the lever arm, the removable counterweight is coupled to the lever arm through one of the plurality of the openings.

10. The thickness detecting system for a paper shredder of claim 1, wherein:

the system further comprises an override switch coupled to the control circuitry, the override switch configured to override the first and second sensors.

11. The thickness detecting system for a paper shredder of claim 10, wherein:

the override switch is further configured to increase power to the motor for shredding overly-thick media.

12. The thickness detecting system for a paper shredder of claim 1, wherein:

the paper shredder comprises a feed opening protection system comprising:

an upper cover having an obverse side and a reverse side, the upper cover having a paper feed opening there through;

a plate having a topside and a bottom side, wherein the bottom side of the plate is disposed proximate to the obverse side of the upper cover, and wherein the plate is selectively positioned to one of fully cover and fully uncover the paper feed opening;

a touch structure configured to mechanically respond to contact therewith; and a preferential power supply switch configured to preferentially control a power supply for performing a shredder protection in response to the touch structure mechanically responding;

wherein the upper cover is configured with one of the touch structure or the preferential power supply switch, and the plate is configured with the other of the touch structure or the preferential power supply switch, and wherein the touch structure and the preferential power supply switch are configured to engagingly interact to control the paper power supply.

13. The thickness detecting system for a paper shredder of claim 12, wherein:

the plate is selectively positioned to uncover the paper feed opening, wherein the selective position of the plate is deflected relative to the paper feed opening, representing an unexpected item being inserted into the paper feed opening, and wherein the shredder plate engagingly interacts the preferential power supply switch to switch off the power supply.

14. The thickness detecting system for a paper shredder of claim 12, wherein:

the plate is selectively positioned to uncover the paper feed opening, and wherein engagingly interacting switches on the power supply.

15. The thickness detecting system for a paper shredder of claim 12, wherein:

the plate is selectively positioned to cover the paper feed opening, and wherein engagingly interacting switches off the power supply.

* * * * *